US006953066B2

(12) United States Patent
Yoneda et al.

(10) Patent No.: US 6,953,066 B2
(45) Date of Patent: Oct. 11, 2005

(54) METHOD OF DISPOSING WEFT IN A LOOM

(75) Inventors: Hidetomo Yoneda, Ishikawa-ken (JP); Mutsuo Fujitani, Ishikawa-ken (JP)

(73) Assignee: Tsudakoma Kogyo Kabushiki Kaisha (JP)

( * ) Notice: Subject to any disclaimer, the term of this patent is extended or adjusted under 35 U.S.C. 154(b) by 51 days.

(21) Appl. No.: 10/437,605

(22) Filed: May 14, 2003

(65) Prior Publication Data

US 2003/0221738 A1 Dec. 4, 2003

(30) Foreign Application Priority Data

May 28, 2002 (JP) ..... 2002-153303

(51) Int. Cl.[7] ..... D03D 47/34

(52) U.S. Cl. ..... 139/435.1; 139/116.1; 139/429; 139/450; 139/451; 139/452

(58) Field of Search ..... 139/116 A, 429, 139/450–452, 116.1, 435.1–435.6, 435

(56) References Cited

U.S. PATENT DOCUMENTS

| | | | | |
|---|---|---|---|---|
| 4,448,223 A | | 5/1984 | Deborde et al. | |
| 4,503,891 A | | 3/1985 | Novak et al. | |
| 4,688,606 A | | 8/1987 | Tamatani | |
| 4,756,341 A | * | 7/1988 | Takehana | 139/435.1 |
| 4,781,221 A | * | 11/1988 | Onishi et al. | 139/116.1 |
| 4,781,224 A | * | 11/1988 | Gotoh et al. | 139/435.2 |
| 4,784,188 A | | 11/1988 | Van Mullekom | |
| 4,815,501 A | * | 3/1989 | Takehana | 139/429 |
| 4,821,779 A | * | 4/1989 | Shaw | 139/116.1 |
| 4,834,145 A | * | 5/1989 | Lewyllie et al. | 139/429 |
| 4,890,650 A | * | 1/1990 | Mitsuya | 139/116.2 |
| 4,993,459 A | * | 2/1991 | Shaw et al. | 139/452 |
| 5,211,207 A | * | 5/1993 | Ichikawa | 139/452 |
| 5,303,745 A | * | 4/1994 | Kaufmann et al. | 139/116.2 |
| 5,544,679 A | * | 8/1996 | Tacq | 139/450 |

FOREIGN PATENT DOCUMENTS

| | | |
|---|---|---|
| EP | 0 867 544 A1 | 9/1998 |
| JP | 60-89720 | 10/1986 |
| JP | 62-41083 | 3/1987 |
| TW | 204379 | 12/2003 |

* cited by examiner

*Primary Examiner*—John J Calvert
*Assistant Examiner*—Robert H Muromoto
(74) *Attorney, Agent, or Firm*—The Webb Law Firm, P.C.

(57) ABSTRACT

The method of disposing the weft, in a loom for displacing the weft led into a weft insert nozzle by jetting the air current from a guide nozzle disposed in a reed sley and releasing the weft from the upstream side of the weft inset nozzle to the vicinity of an intake of an discharge device, is characterized in that, when displacing the weft to the vicinity of the intake, the reed sley is stopped at a position where the air current from the guide nozzle is directed to the vicinity of the intake.

6 Claims, 6 Drawing Sheets

METHOD OF DISPOSING WEFT IN A LOOM

BACKGROUND OF THE INVENTION

1. Field of the Invention

The present invention relates to a method of disposing a defective yarn such as a mis-inserted weft, joined yarns having a joint and the like.

2. Description of Prior Art

As one of techniques to remove a mis-inserted weft which failed in insertion, there is a method (disclosed in Japanese Utility Model Application No. 62-41083) of displacing the mis-inserted yarn to the outside of a weft running passage by jetting an air current from a guide nozzle disposed in a reed sley, while releasing the weft by a length required for delivering the mis-inserted yarn to a defective yarn take-up device and discharge device from the side of a weft insert nozzle, and transfers the mis-inserted yarn in a state of extending from a cloth to the discharge device.

According to the foregoing prior art, however, since not only the guide nozzle but also the mis-inserted yarn to be displaced is swung back and forth by inertial rotation of a loom, the attitude of the mis-inserted yarn is not stabilized, resulting in a failure in delivering the mis-inserted yarn to the take-up device.

Also, among apparatus for delivering a defective yarn to a discharge device to remove it, there is not only a device for removing mis-inserted yarn such as mentioned above but also a device for removing a weft portion (joined yarns) having a joint, a device for removing a yarn tail end portion (tail end yarn) in an automatic reparation device for a running out weft and so forth. Even such removing devices sometimes fail in delivering a defective yarn as mentioned above.

SUMMARY OF THE INVENTION

An object of the present invention is to realize surer delivery of a defective yarn to a discharge device when the weft is defective, in a loom for discharging out of a system a weft led into a weft insert nozzle.

The method of disposing the weft according to the present invention in a loom which displaces the weft led into the weft insert nozzle to the vicinity of the intake of the discharge device, by jetting an air current from a guide nozzle disposed in a reed sley and releasing the weft, comprises a step of stopping the reed sley at a position where the air current from the guide nozzle is oriented toward the vicinity of the intake.

When displacing the weft to the vicinity of the intake of the discharge device, the air current is jetted from the guide nozzle toward the vicinity of the intake, so that the weft is surely displaced to the vicinity of the intake and delivered to the discharge device.

When displacing the weft, the displacement of the weft may be done by the air current from the guide nozzle while releasing the weft with the reed sley stopped at the position.

In place of this, when displacing the weft, the reed sley may be stopped at the position by rotating the loom while releasing the weft and displacing the weft by the air current from the guide nozzle.

The weft may be displaced through a defective yarn guide disposed in the reed sley and having an air current passage one end of which is opposed to a nozzle for the air current by the guide nozzle and the other end of which is opposed to the intake. Thus, it is possible to make the air current from the guide nozzle effectively act on the defective yarn by the defective yarn guide.

Further, when mis-insertion occurs, it is possible to displace the mis-inserted weft in a state of being led into the weft insert nozzle, to expose it at a cloth fell, and to discharge it thereafter by the discharge device.

In relation to releasing the weft and stopping of the reed sley when displacing the weft to the vicinity of the intake, it is possible, more concretely, for example, to release at the same time the weft portions of a length required for delivery, sweep them in advance from the guide nozzle by the air current, and then rotating the loom to stop the reed sley at the position and displace the weft in the vicinity of the intake.

Contrarily to the foregoing, it is possible, after stopping the reed sley at the position, to release and sweep the weft portions of a length required for delivery by the air current, thereby displacing the weft portions to the vicinity of the intake.

It is also possible to release the weft a plural of times by a length required for disposal. For example, firstly the weft portion of the minimum required length depending on the cause of occurrence of the defective yarn is released, then the reed sley is stopped at the position, and lastly, the weft portion of the remaining length is released.

The vicinity of the intake can include a range capable of introducing the weft into the intake, for example, an area where the suction force affects the weft in case of a device for taking the weft into an intake by suction.

DETAILED DESCRIPTION OF THE PREFERRED EMBODIMENTS

Figure 1:
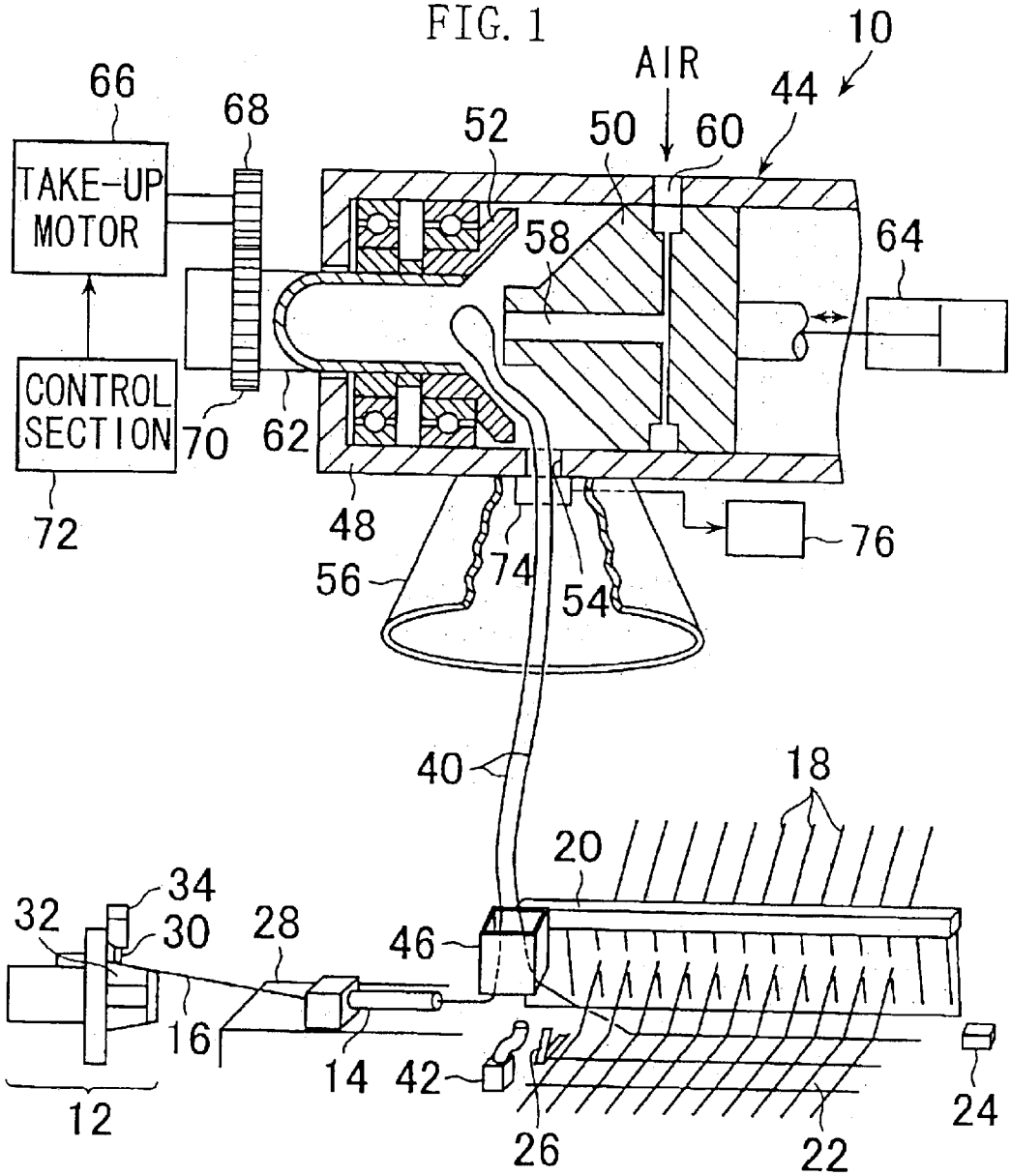
FIG. 1 is a view showing an embodiment of weft disposing apparatus for disposing weft for working the method of disposing weft according to the present invention.

Referring to FIG. 1, a weft disposing apparatus 10 for disposing weft is incorporated into a device for removing mis-inserted weft in an air-jet loom.

The air-jet loom inserts the weft 16, which extending from a length measurement storage unit 12 and is led into a weft insert nozzle (main nozzle) 14, into a shed of the warp 18 by the compressed air from the weft insert nozzle 14 as well as a plurality of sub-nozzles (not shown) and weaves the weft 16 into a cloth 22 by beating the weft 16 against a cloth fell by the reed 20.

The fact that the weft 16 is correctly inserted is detected by a weft feeler 24. When the weft 16 is correctly inserted, the weft 16 is cut off with a cutter 26 after beating. The weft insert nozzle 14 and a plurality of sub-nozzles, being incorporated into the reed sley 28 which has the reed 20 assembled into itself, are displaced together with the reed 20 with the beating.

The cutter 26 is driven by a machine-operated mechanism so as to cut off the weft by the rotation force of the main shaft of the loom after beating. The cutter 26 may be a cutter driven by utilizing the drive force of an actuator independent from the main shaft, such as a motor or a solenoid which is driven in synchronism with the main shaft of the loom, a cutter like heat of a heater excited in synchronism with the rotation of the main shaft of the loom, or other suitable ones.

The length measurement storage unit 12, in the illustration, is a drum-type length measurement storage unit which is provided with an engagement pin 30 and an engagement pin solenoid 34 for driving the pin 30 so as to freely advance and retreat relative to the periphery of the drum 32. In a state that the weft 16 extending to the weft insert nozzle 14 is engaged with the engagement pin 30, the yarn guide not shown is rotated around a drum 32, thereby winding the weft extending from a weft package not shown by predetermined rounds on the drum 32 for storing there. When inserting the weft and removing a defective yarn, the unit 12 makes the engagement pin 32 retreat to disengage the weft 16 while turning ON the engagement pin solenoid 34. In stead of the length measurement storage unit 12, however, another length measurement storage unit may be used.

Embodiments of Weft Disposing Apparatus

The apparatus 10 for disposing weft comprises a blow-up nozzle 42 for jetting (or spouting) upward the air current which blows up a defective yarn 40 (a mis-inserted yarn in this embodiment), an discharge device 44 disposed above the blow-up nozzle 42 so as to discharge the blown-up defective yarn 40 outside the weft running passage, and a defective yarn guide 46 for guiding the defective yarn to be blown up by the air current to the discharge device 44.

The blow-up nozzle 42 is assembled into the reed sley 28 so as to act as a guide nozzle for displacing the defective yarn 40 to the discharge device 44 and jets the compressed air when removing the defective yarn. By this, a so-called blow-up action for blowing up the defective yarn 40 by the jetted compressed air (i.e., the air current) is performed. The blow-up nozzle 42 may be assembled into the reed sley 28 through a suitable member such as the reed 20.

The discharge device includes a cylindrical casing 48 disposed above the guide nozzle i.e., blow-up nozzle 42, a pair of rotors 50, 52 disposed inside the casing 48 rotatably about the axis of the casing 48 and relatively movably in the axial direction of the casing 48, and an introduction guide 56 for introducing the defective yarn 40 to be blown up by the blow-up nozzle 42 and the air current to the vicinity of an intake 54.

The rotors 50 and 52 are provided at an interval in the axial direction of the casing 48 and have a convex side and a concave side of truncated conical shape, respectively, facing each other.

The defective yarn guide 46, whose internal space is used as an air current path for the air current to pass, is shaped like a short cylinder and is assembled into the reed sley through the reed 20 such that the lower end of the air current path opposes to the jet nozzle of the blow-up nozzle 42 and that the upper end can be moved to a position opposing to the intake 54 with the movement of the reed 20.

However, the defective yarn guide 46 is not necessarily cylindrical and, if it has a guide face for guiding the air current to the intake 54, it may be a member having other shape than a cylindrical shape such as one having one or more wall faces (for example, master blade of the reed) with a guide face extending toward the intake 54 or having an air passage opening at one end like a one-side open rectangular shape.

Also, the defective yarn guide 46 may be assembled into the reed sley 28 through a member other than the reed 20 or directly into the reed sley 28. Further, even without the defective yarn guide 46, a device which can bring a defective yarn to the vicinity of the intake 54 only by the air current could be employed.

Between the rotors 50 and 52, the compressed air is jetted (or spouted) from a nozzle section 58 formed in one of the rotors 50.

The compressed air to be jetted from the nozzle section 58 is supplied from a hole 60 of the casing 48 to the nozzle section 58 and escapes to the outside through a cylindrical shaft 62 which is assembled coaxially into the other rotor 52 and penetrates the rotor 52.

By the compressed air jet from the nozzle section 58, a so-called defective yarn sucking motion is performed, that is, the gap between the rotors 50 and 52 and the vicinity of the intake 54 are lowered in pressure to get below the standard, thereby sucking into the intake 54 a part of the defective yarn 40 blown up to the vicinity of the intake 54.

The rotor 50 is advanced toward the rotor 52 by a pressing cylinder 64, with the part of the defective yarn 40 sucked between the rotors 50 and 52, and presses its convex side against the concave side of the rotor 52. Thus, the part of the defective yarn 40 is sandwiched between the rotors 50 and 52.

On the other hand, the other rotor 52 is rotated by a motor 66 for taking up a defective yarn through a pair of gears 68, 70 and the cylindrical shaft 62, with the part of the defective yarn 40 sandwiched between the rotors 50 and 52. Thus, so-called defective yarn taking-up motion for taking up the defective yarn 40 by both rotors 50, 52 is started. Rotation and stopping of the motor 66 are controlled by a control section 72.

When the defective yarn 40 is taken up by the rotors 50, 52, the rotor 50 is moved retreated by the cylinder 64 with the compressed air being jetted from the nozzle section 58. Thereby, a so-called defective yarn discharging motion for discharging the taken-up defective yarn 40 outside through the cylindrical shaft 62 is started.

Whether or not the defective yarn 40 was taken up or whether or not it was discharged by the discharge device 44 is confirmed by detecting the defective yarn 40 by means of a yarn sensor 74 disposed in the intake 54 and by monitoring the output signal of the yarn sensor 74 at a monitoring section 76.

The reed sley 28 is stopped at a position where the air current from the blow-up nozzle 42 is directed to the vicinity of the intake 54 when at least a part of the defective yarn 40 is displaced to the vicinity of the intake 54 by the air current from the blow-up nozzle 42. In this state, the other end of the air current passage of the defective yarn guide 46 opposes to the intake 54.

Since by this the air current is jetted from the blow-up nozzle 42 to the vicinity of the intake 54 through the defective yarn guide 46, the defective yarn 40 is surely displaced to the vicinity of the intake 54 and delivered to the discharge device 44. This settles inconveniences such as productivity lowered due to lingering stoppage for reparation as a result of misdelivery of the defective yarn to the discharge device, as in a conventional automatic repairing device.

During the period from the start of the defective yarn blow-up motion till the start of the defective yarn take-up motion, the weft portion of a length required for delivering the defective yarn is released at one time or in several times from the length measurement storage unit 12, and also the weft is let off from the weft insert nozzle 14 to be inserted into the warp shed.

During the defective yarn take-up motion, the defective yarn 40 passes the defective yarn guide 46 without extending directly from the shed of the warp 18 to the intake 54. This reduces the friction between the yarn portion at the shed of the warp 18, particularly the yarn portion at the shed of the warp 18 on the weft insertion side (weft nozzle side) and the defective yarn 40 and prevents damage to the yarn portion at the shed.

Embodiments of Weft Disposing Method

Explanation is given below with reference to FIGS. 2 to 6 as to embodiments of the method of disposing a defective yarn (in this example, mis-inserted weft) due to failure in weft insertion by the above-mentioned weft disposing apparatus 10.

Figure 2:
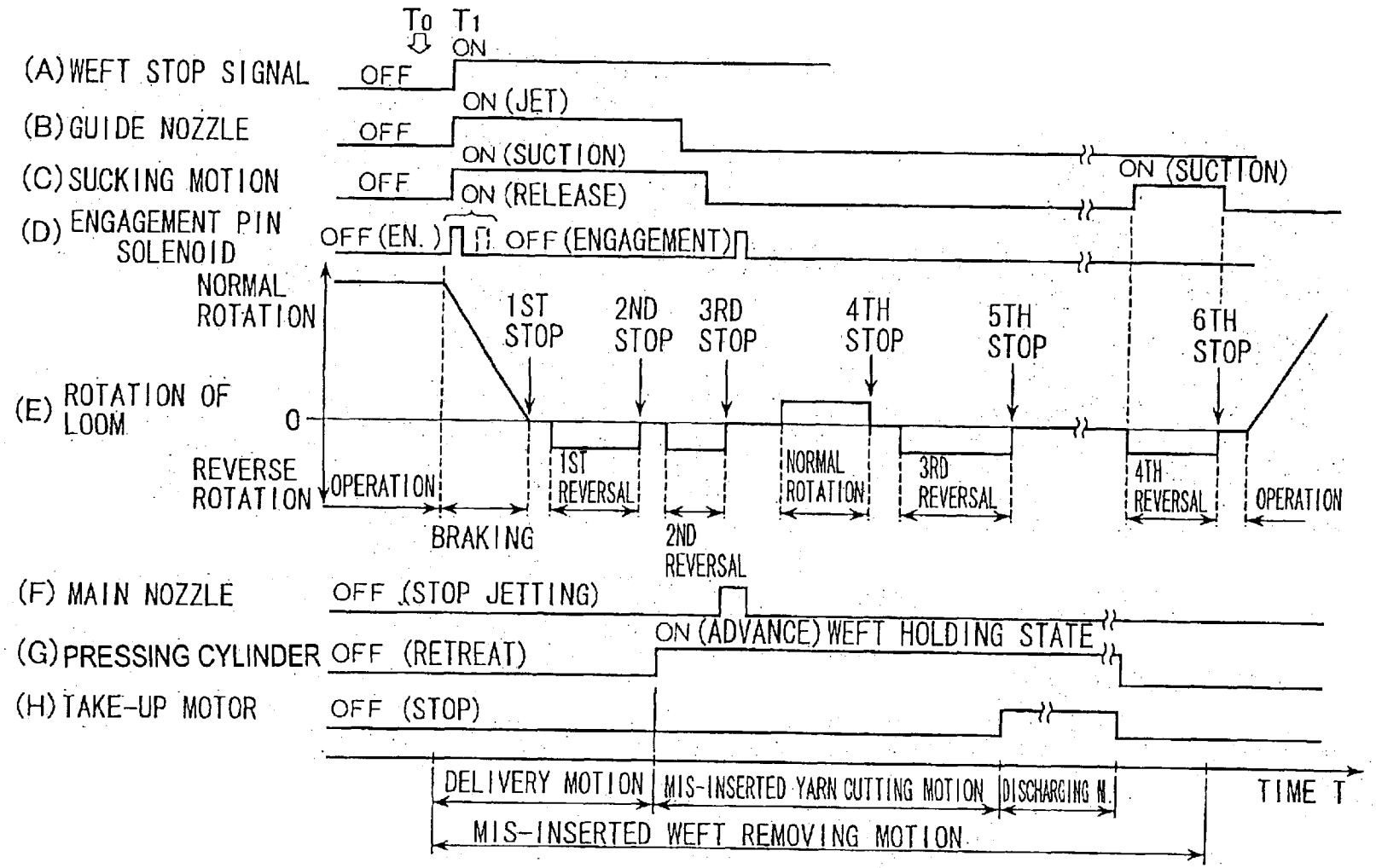
FIG. 2 is a flow chart illustrating an embodiment of the method of disposing weft by the apparatus in FIG. 1.
Figure 3:
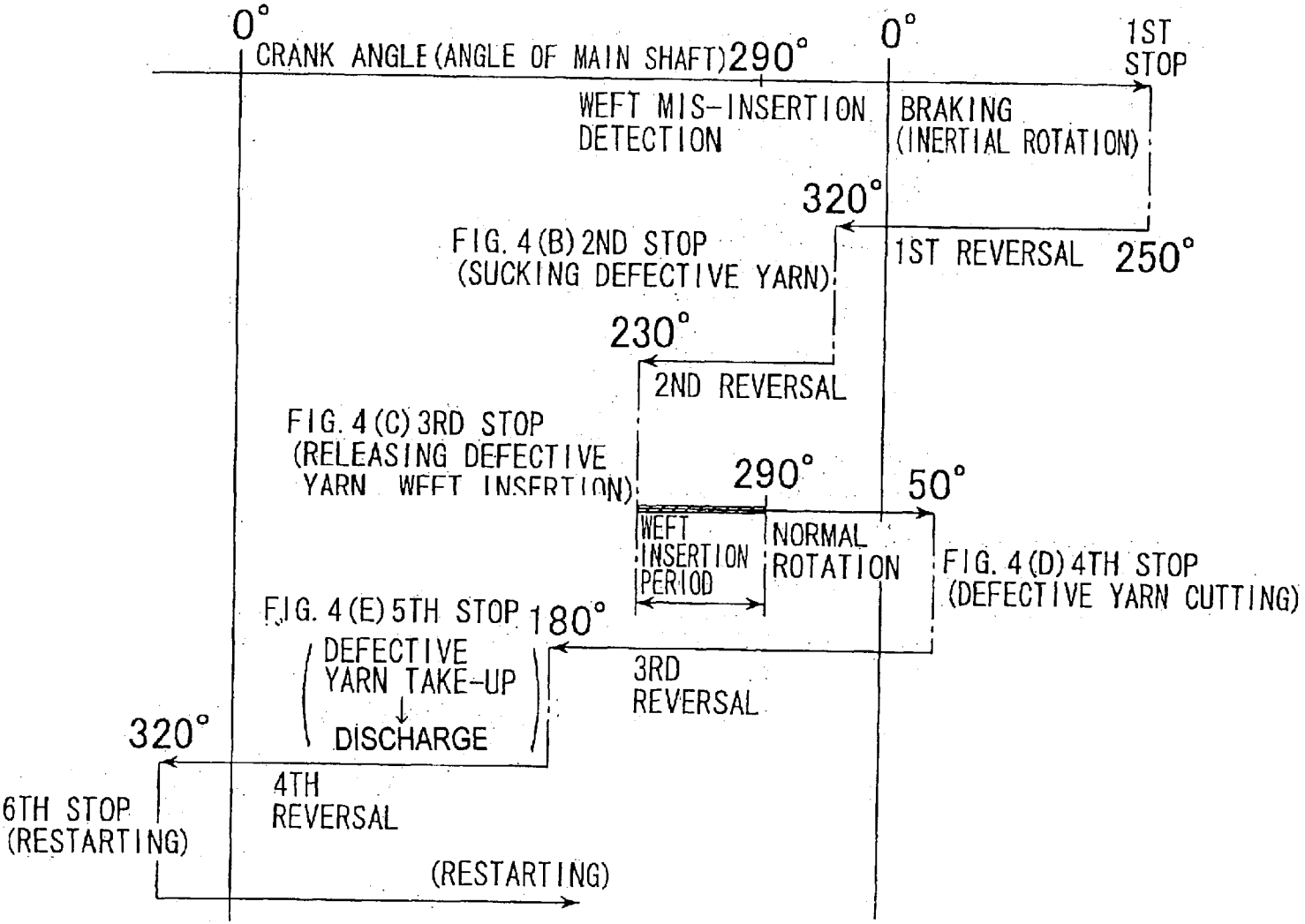
FIG. 3 is a flow chart illustrating states of rotation and stoppage of the loom relative to the angle of rotation of the main shaft of the loom in the embodiment of the method of disposing weft according to the apparatus in FIG. 1.

First, as shown in FIGS. 2 and 3, if a failure in weft insertion occurs at time T0, a weft stop signal shown in FIG. 2(A) is generated at subsequent time T1, for example, at a weft detection timing (290° at the crank angle (likewise hereunder)).

Thus, when the guide nozzle 42 is turned on as shown in FIG. 2(B), the air current is jetted, so that the defective yarn blow-up motion is started, also when the sucking motion is turned on as shown in FIG. 2(C), the defective yarn sucking motion is started, so that the compressed air is jetted from the nozzle portion 58 of the rotor 50.

Figure 4A:
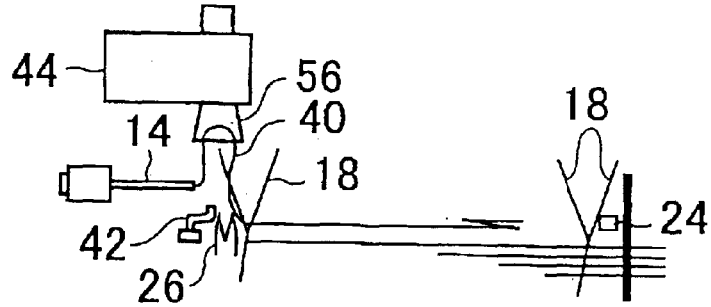
FIG. 4 is a view illustrating a displaced state of a defective yarn in the embodiment of the method of disposing weft according to the apparatus in FIG. 1.

Further when the weft stop signal shown in FIG. 2(A) is generated, the engagement pin solenoid 34 is driven to retreat/advance for a short time as shown in FIG. 2(D), so that a weft portion of 1 turn is released from the length measurement storage unit 12. However, since the released weft portion is blown up by the air current from the guide nozzle 42 as shown in FIG. 4(A), the defective yarn 40 evades from cutting by the cutter 26 and is in a state of being let into the weft insert nozzle 14.

The angular rotational position (or attitude) of the reed sley 28 into which the reed 20, the guide nozzle 42 and the defective yarn guide 46 are assembled, relative to the intake 54 when the defective yarn blow-up motion is started, is not always the position where the air current (in the illustration, the air current passing the defective yarn guide 46) from the guide nozzle 42 is directed to the vicinity of the intake 54 of the discharge device 44.

Figure 5:
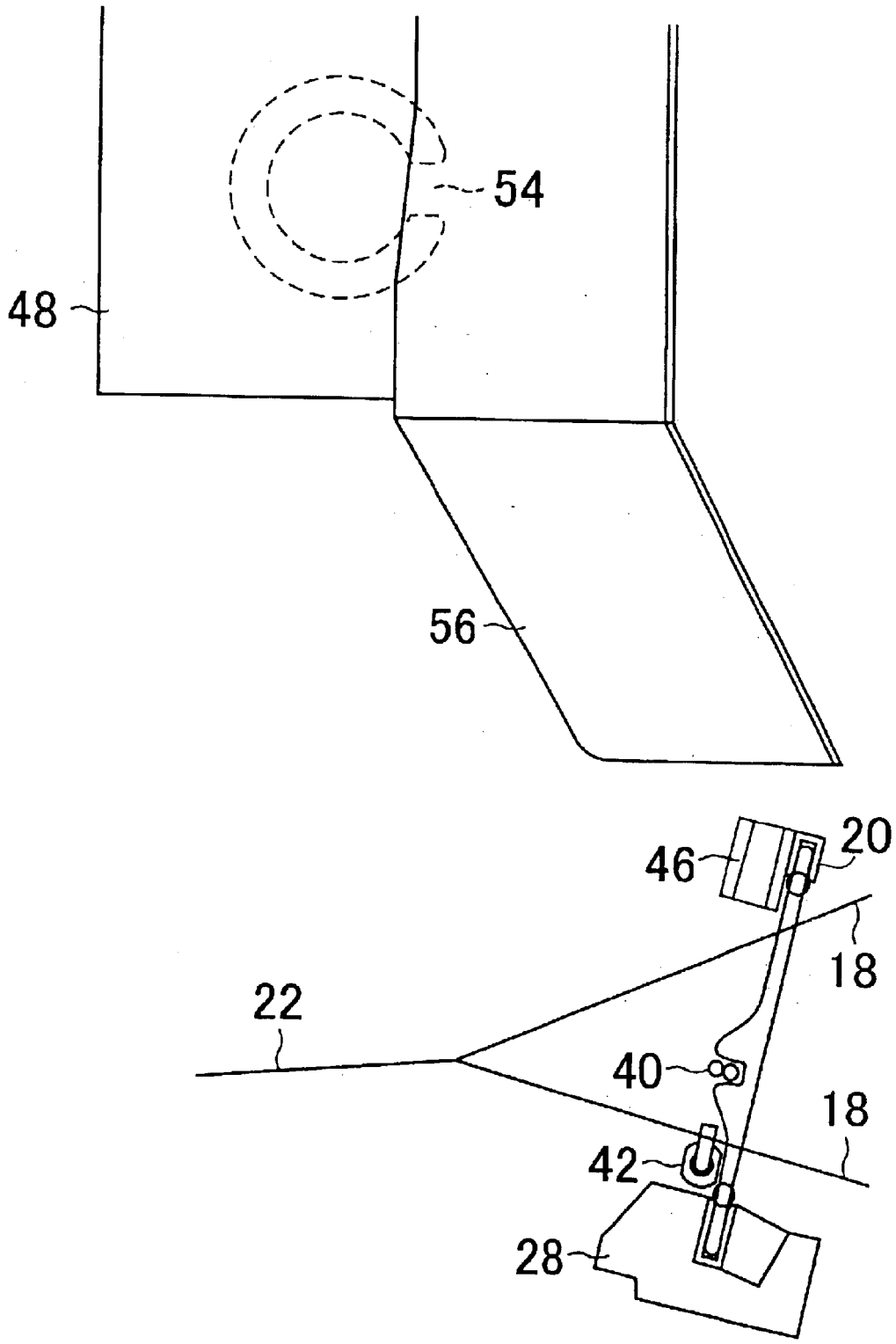
FIG. 5 is a view showing the relation between the reed and the intake when weft insertion is detected.

For example, when the defective yarn blow-up motion is started, the reed sley 28 takes a position, relative to the intake 54, where the air current passing the defective yarn guide 46 from the guide nozzle 42 is not directed to the vicinity of the intake 54, as shown in FIG. 5. When the reed sley 28 is in the position shown in FIG. 5, the defective yarn 40 is not always surely blown up to the vicinity of the intake 54.

When the weft stop signal shown in FIG. 2(A) is generated, the control force further acts on the loom as shown in FIG. 2(E) and FIG. 3, and after performing inertial rotation for a predetermined time, the loom stops at a predetermined position (a first stop position).

If the timing of detecting a failure in weft insertion, that is, the timing that the weft stop signal is outputted is at 290°, the first stop position of the loom will be at a time within the weaving cycle following beating (0°), e.g., at 250° as shown in FIG. 3.

The angular rotational position of the reed sley 28 relative to the intake 54 in the first stop position of the loom also is not always the position where the air current passing the defective yarn guide 46 from the guide nozzle 42 is directed to the vicinity of the intake 54 of the discharge device 44.

Next, the loom is slowly reversed (first reversal), as shown in FIGS. 2(E) and 3, up to a position where the air current passing the defective yarn guide 46 from the guide nozzle 42 to the intake 54, e.g., up to 320°, and stops at the position (second stop position). Thereafter, as shown in FIG. 2(D), the engagement pin solenoid is driven to retreat/advance for a short time, thereby releasing the weft of 1 turn or more.

Figure 4B:
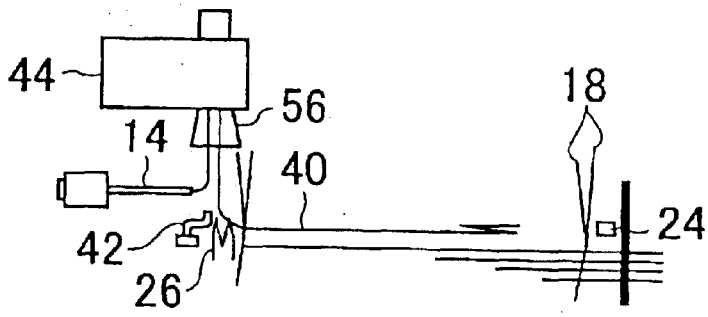
Figure 6:
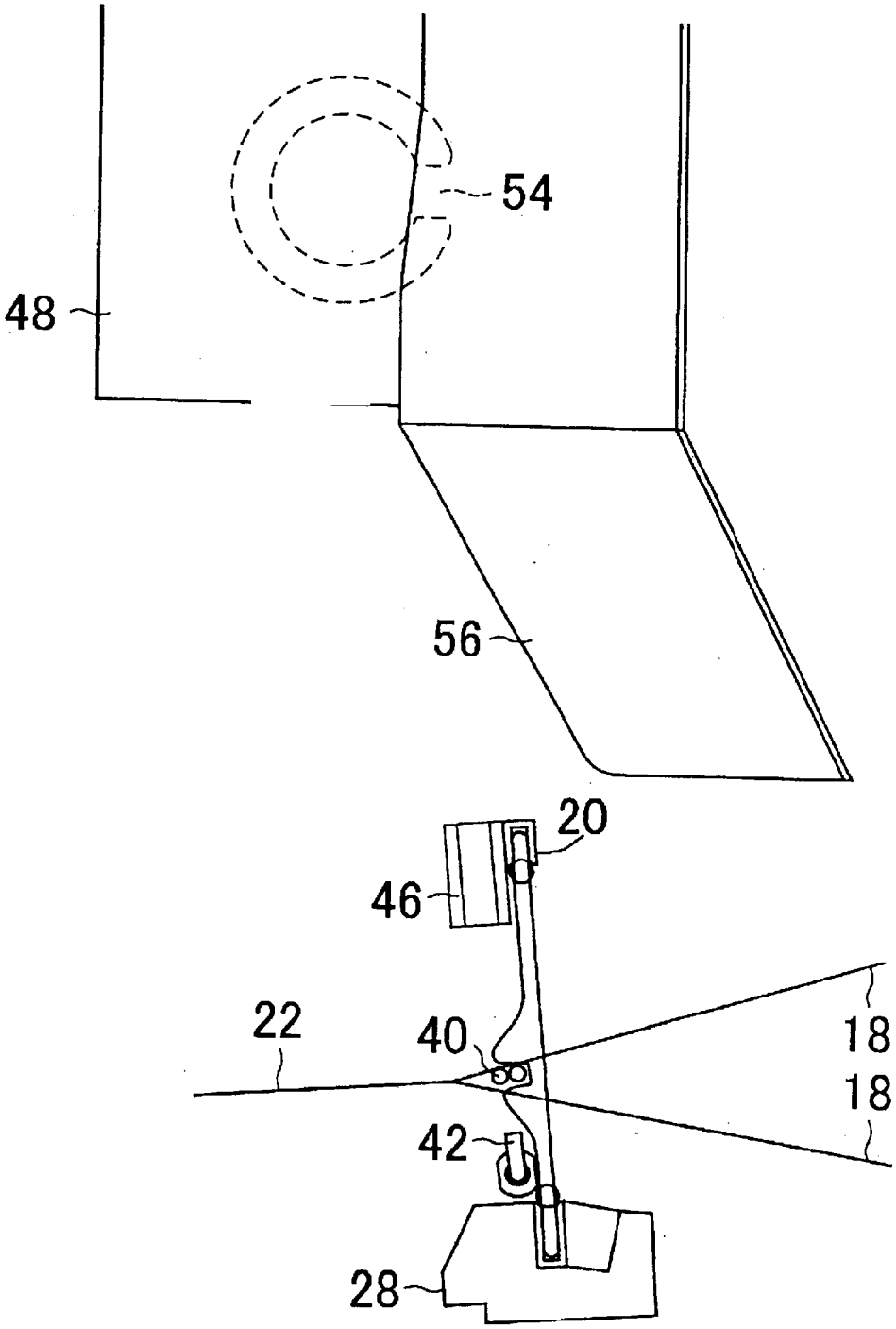
FIG. 6 is a view showing the relation between the reed and the intake when a defective yarn is delivered.

The angular rotational position of the reed sley 28 relative to the intake 54 at the second stop position of the loom is, as shown in FIG. 6, a position where the air current passing the defective yarn guide 46 from the guide nozzle 42 is directed to the vicinity of the intake 54 of the discharge device 44. By this, the defective yarn 40 is sucked into the casing 48 through the intake 54, because of the fact that a part of the defective yarn 40 reaches the vicinity of the intake 54 of the discharge device 44 as shown in FIG. 4(B), that the weft is further released, and that at this time point the discharge device 44 is still sucking the defective yarn.

Also, when the reed sley 28 is moved to the second stop position, the defective yarn guide 46 is moved with the movement of the reed sley 28, and the other end of the air passage whose one end is opposed to the air current nozzle-by the guide nozzle is opposed to the intake 54, so that the air current from the guide nozzle 42, raised in directivity by the defective yarn guide 46, effectively acts on the defective yarn 40, which is surely blown up to the vicinity of the intake 54 and surely sucked into the casing 48.

While the loom is stopped at the second stop position, the rotor 50 of the discharge device 44 is advanced by the cylinder 64, as shown in FIG. 2(G), and maintained at the advanced position. Thus, the defective yarn 40 is held with its upper end portion sandwiched between the rotors 50 and 52.

When the rotor 50 is advanced, the jet of the air current from the guide nozzle 42 is stopped as shown in FIG. 2(B).

Then, the loom is reversed slowly, as shown in FIG. 2(E) and FIG. 3, up to a suitable angle before the detection timing of mis-insertion of the weft (290°), e.g., 230° (second reversal) and stops at the position (third stop position). Thereafter, when the engagement pin solenoid 34 is driven to retreat/advance for a short time, a weft portion of 1 turn or more is released, and also, when the weft insert nozzle 14 is driven to jet, the released weft is inserted. The jet of the compressed air from the nozzle section 58 of the discharge device 44 is stopped during the second reversal, as shown in FIG. 2(C), and maintained in that state. Thus, the full amount of the weft required for the delivery of the defective yarn 40 is released in several times from the upstream side of the weft insert nozzle 14.

Figure 4C:
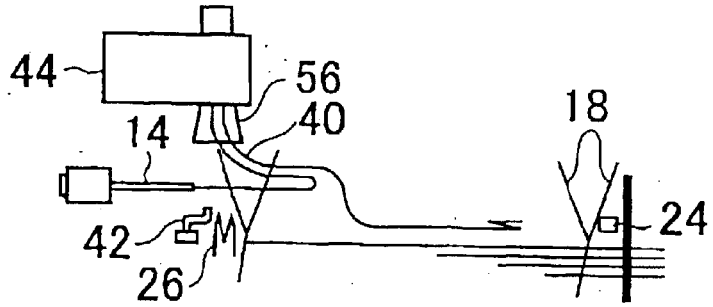
Figure 4D:
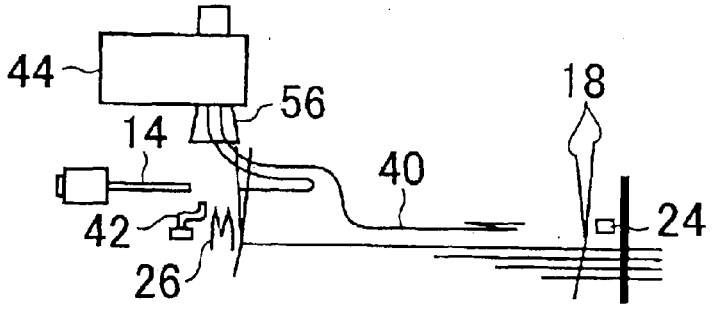

In a state that the loom is stopped at the third stop position, the weft of 1 turn or more is further released from the length measurement storage unit 12, as shown in FIGS. 2(D), (F) and FIG. 3, let off by the jet from the weft insert nozzle 14 and inserted into the warp shed to come to the state shown in FIG. 4(C).

Then, the loom is normally rotated slowly up to an angle (e.g., 50°) to cut the weft, as shown in FIGS. 2(E) and 3, and stops at the position (fourth stop position). The above-mentioned weft insertion of the defective yarn 40 may be completed by the time to terminate the ordinary weft insertion period (e.g., 290°).

When the loom arrives at the fourth stop position, the cutter 26 is actuated. Since at this time point the air current jet from the guide nozzle 42, the compressed air jet from the nozzle portion 58 and the defective yarn take-up motion by the discharge device are stopped, the inserted weft portion is brought to a position where the cutter 26 can cut it by the beating motion, and the cutter 26 is closed upon rotation of the main shaft. Consequently, the defective yarn 40 is cut off at the front end of the weft insert nozzle.

Next, the loom is reversed slowly (third reversal) as shown in FIGS. 2(E) and 3 up to the farthest position for the reed 20 to retreat (180°) and stops at the position (fifth stop position).

Figure 4E:
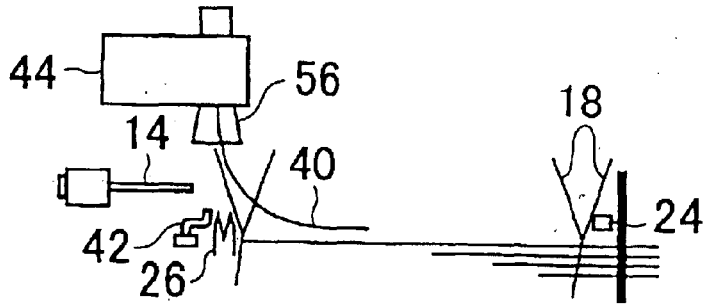

When the loom is stopped at the fifth stop position, the rotor 52 of the discharge device 44 is rotated by a motor 66 as shown in FIGS. 2(H) and 3. By this, the defective yarn 40 is taken up by the rotors 50, 52 as shown in FIG. 4(E).

Then, the loom is further reversed slowly up to the position to start operation, for example, 320° (fourth reversal), as shown in FIGS. 2(E) and 3, and stopped at the position (sixth stop position).

Next, the loom is made to resume its operation from a predetermined time as shown in FIGS. 2(E) and 3.

According to the above-mentioned weft disposing apparatus 10 and weft removing method, the defective yarn 40, being displaced by the air current jetted to the vicinity of the intake 54 from the guide nozzle 42, is surely displaced to the vicinity of the intake 54 and surely delivered to the discharge device 44.

Other Embodiments of Weft Disposing Method

Releasing of the weft from the upstream side of the weft insert nozzle 14 may be performed as follows.

In case the weft is released from the upstream side of the weft insert nozzle 14 in several times, the weft portion of 1 turn or more may be released during the inertial rotation of the loom, as shown in FIG. 2(D) by a dotted line.

It is also possible to release a weft portion of an amount necessary for delivery of the defective yarn 40 at one time during the inertial rotation of the loom, instead of releasing the weft from the upstream side of the weft insert nozzle 14 in several times.

Further, the loom is slowly rotated to displace the reed sley 28. And the time for stopping the reed sley 28 at a position where the air current from the guide nozzle 42 is directed to the vicinity of the intake 54 of the discharge device 44 may be a time for displacing the defective yarn to the vicinity of the intake 54 by the air current from the guide nozzle 42 while releasing the weft from the upstream side of the weft insert nozzle 14.

In case of employing, as the cutter 26, one which utilizes the force independent from the main shaft of the loom such as a cutter using the drive force of an actuator independent from the main shaft of the loom or a cutter using the heat of a heater excited in synchronism with the rotation of the main shaft of the loom, it is possible to electrically stop the action of the cutter utilizing the force independent from the inertial rotation of the loom, the first reversal rotation, the normal rotation, the first reversal, the normal rotation of the loom to the fourth stop position and the third reversal of the loom.

The present invention can be modified as follows.

After the delivery of the defective yarn 40 to the discharge device 44, instead of having the normally inserted cutter 26 cut the defective yarn 40, it is possible to cut the weft with a cutter provided at the front end of the weft insert nozzle, the cutter being exclusively used for cutting a defective yarn, as shown in Japanese Utility Model Appln. PD NO. 62-41083.

In place of a type of discharge device which takes up a defective yarn, another type of device such as sucking the defective yarn by the air current may be used. Also, in place of disposing a discharge device above the reed sley, it may be disposed at such a place as under the reed sley, in the moving direction of the reed sley (the advanced end or retreated end) and so forth.

It is possible to draw into the intake the defective yarn displaced to the vicinity of the intake, not by the air current, but by another technique such as holding mechanically.

The present invention can be applied not only to an discharge device of a mis-inserted yarn failed in weft insertion but to any art of disposing the weft in a weft disposing apparatus of another type such as a device for removing a weft portion having a joint (joined yarn), a device for removing a yarn tail end portion in an automatic repairer of the weft which is running out, a device for removing a weft portion led into a weft insert nozzle prior to resuming operation of a loom after stoppage, etc.

The present invention can be variously modified without limitation to the above embodiments, unless departing from its purpose.

What is claimed is:

1. A method of disposing a weft in a loom which comprises: a reed sley, a weft length measurement storage unit, a guide nozzle disposed in the reed sley for jetting an air current to displace the weft led into a weft insert nozzle, and a discharge device for discharging a defective yarn, said discharge device fixed at a position opposing said guide nozzle at a part of a swinging range of said reed sley, wherein, when mis-insertion occurs, said weft is displaced to a vicinity of an intake of said discharge device by the air current from said guide nozzle to deliver the weft to said discharge device, the method comprising the steps of:

stopping said reed sley at a position where the air current from said guide nozzle is directed to the vicinity of said intake when reversing after stopping of the loom due to an occurrence of mis-insertion, and delivering the weft to said discharge device.

2. The method of claim 1, further comprising the step of releasing said weft from said length measurement storage unit, when displacing said weft.

3. The method of claim 2, wherein said step of displacing said weft is carried out by jetting the air current from said guide nozzle while releasing said weft from said length measurement storage unit with said reed sley stopped at said position.

4. The method of claim 2, wherein said step of stopping said reed sley at said position is carried out while releasing said weft from said length measurement storage unit and displacing said weft by the air current from said guide nozzle.

5. The method of claim 2, wherein said step of displacing said weft is carried out through a defective yarn guide disposed in said reed sley and having an air current passage one end of which is opposed to an outlet for the air current from said guide nozzle and the other end of which is opposed to said intake.

6. The method of claim 1, wherein, in case of a failure in weft insertion, the mis-inserted weft is displaced in a state of being led into said weft insert nozzle, exposed at a cloth fell and discharged thereafter by the discharge device.

* * * * *